US007578712B2

(12) United States Patent
Chang

(10) Patent No.: US 7,578,712 B2
(45) Date of Patent: Aug. 25, 2009

(54) CONTACT SPRING ASSEMBLY FOR ELECTRONIC DEVICES

(75) Inventor: Cheng-Lung Chang, Tu-Cheng (TW)

(73) Assignee: Chi Mei Communication Systems, Inc., Tu-Cheng, Taipei County (TW)

( * ) Notice: Subject to any disclaimer, the term of this patent is extended or adjusted under 35 U.S.C. 154(b) by 0 days.

(21) Appl. No.: 11/964,801

(22) Filed: Dec. 27, 2007

(65) Prior Publication Data

US 2009/0042453 A1 Feb. 12, 2009

(30) Foreign Application Priority Data

Aug. 10, 2007 (CN) ..... 2007 1 0201341

(51) Int. Cl.
*H01R 11/22* (2006.01)

(52) U.S. Cl. ..... 439/816; 200/292

(58) Field of Classification Search ..... 439/816, 439/66; 200/292, 530, 532
See application file for complete search history.

(56) References Cited

U.S. PATENT DOCUMENTS

| | | | | | |
|---|---|---|---|---|---|
| 287,320 | A * | 10/1883 | Perkins | 337/187 |
| 2,731,609 | A * | 1/1956 | Sobel, III | 439/74 |
| 2,825,037 | A * | 2/1958 | French | 439/65 |
| 3,243,562 | A * | 3/1966 | O'Brien | 200/241 |
| 3,350,530 | A * | 10/1967 | Fry | 200/252 |
| 3,356,817 | A * | 12/1967 | Matthews | 200/260 |
| 3,493,706 | A * | 2/1970 | Anderson et al. | 200/16 D |
| 3,617,980 | A * | 11/1971 | Alkire et al. | 439/223 |
| 3,809,838 | A * | 5/1974 | Coppola | 200/532 |
| 3,917,917 | A * | 11/1975 | Murata | 200/517 |
| 4,136,269 | A * | 1/1979 | Weidler | 200/535 |
| 4,307,268 | A * | 12/1981 | Harper | 200/5 A |
| 4,350,855 | A * | 9/1982 | Bobb et al. | 200/292 |
| 4,752,254 | A * | 6/1988 | Inoue et al. | 439/834 |
| 4,789,764 | A * | 12/1988 | Doros | 200/520 |
| 5,924,557 | A * | 7/1999 | Pollock | 200/534 |
| 6,132,220 | A * | 10/2000 | McHugh et al. | 439/66 |
| 6,227,870 | B1 * | 5/2001 | Tanaka | 439/66 |
| 6,365,848 | B1 * | 4/2002 | Maple | 200/5 A |
| 6,398,559 | B2 * | 6/2002 | Tanaka | 439/66 |
| 6,500,012 | B1 * | 12/2002 | Billenstein et al. | 439/92 |
| 6,561,819 | B1 * | 5/2003 | Huang et al. | 439/66 |
| 2004/0121629 | A1 * | 6/2004 | You | 439/66 |
| 2004/0132319 | A1 * | 7/2004 | Richter et al. | 439/66 |
| 2005/0009380 | A1 * | 1/2005 | Brown et al. | 439/66 |
| 2007/0059976 | A1 * | 3/2007 | Yeh et al. | 439/500 |

* cited by examiner

*Primary Examiner*—T C Patel
*Assistant Examiner*—Vladimir Imas
(74) *Attorney, Agent, or Firm*—Steven M. Reiss

(57) ABSTRACT

A contact spring assembly (30) for an electronic device includes a mounting portion (31), a press spring (32), and a deformable spring (37). The press spring and the deformable spring are respectively bent from the mounting portion. The press spring resists the deformable spring. The press spring is configured to be moved along a first direction and push the deformable spring to move along a second direction different from the first direction.

14 Claims, 7 Drawing Sheets

CONTACT SPRING ASSEMBLY FOR ELECTRONIC DEVICES

BACKGROUND OF THE INVENTION

1. Field of the Invention

The present invention generally relates to contact spring assemblies, particularly to a contact spring assembly used in an electronic device.

2. Discussion of the Related Art

Contact spring assemblies are commonly used in input devices or control devices, for example, keys of mobile phones and switches of various electronic devices.

Referring to FIG. 1, a typical key assembly 10 using a contact spring 11 is mounted on a printed circuit board 20, which has at least one conductive contact 21. The key assembly 10 includes the contact spring 11, a flexible supporting sheet 12, and a key body 13. Referring to FIG. 2, the contact spring 11 is a strip-shaped metal sheet, and includes a press portion 110, two fixing feet 111, and a conductive connector 115. The press portion 110 is bent to supply elastic force. The two fixing feet 111 are respectively formed on two ends of the press portion 110, so as to fix the press portion 110 onto the printed circuit board 20. The conductive connector 115 is attached to a middle portion of the press portion 110 and faces the conductive contact 21 of the printed circuit board 20. The flexible supporting sheet 12 covers the contact spring 11, with a portion resisting against the press portion 110. The key body 13 is disposed on the flexible supporting sheet 12. When the key body 13 is pressed, the supporting sheet 12 is forced to deform the press portion 110 of the contact spring 11. The conductive connector 115 is moved to contact the conductive contact 21 by the deformation of the press portion 110, thereby creating an electric signal to the printed circuit board 20. When the key body 13 is released, the press portion 110 rebounds from the deformation thereof. The conductive connector 115 is then moved away from the conductive contact 21.

The conductive connector 115 can only be moved along a direction the same as that of the pressure applied onto the key body 13. Thus, the conductive contact 21 of the printed circuit board 20 must be defined under the conductive connector 115 or be covered by the contact spring 11.

Furthermore, the contact spring 11 may be permanently deformed in case of that a relatively high stress is applied to the key body 13, or undergoing repetitively pressure.

Therefore, an improved contact spring assembly is desired in order to overcome the above-described shortcomings.

SUMMARY

A contact spring assembly for an electronic device is provided. The contact spring assembly includes a mounting portion, a press spring, and a deformable spring. The press spring and the deformable spring are respectively bent from the mounting portion. The press spring resists the deformable spring. The press spring is configured to be moved along a first direction and push the deformable spring to move along a second direction different from the first direction.

Other advantages and novel features will become more apparent from the following detailed description of preferred embodiments when taken in conjunction with the accompanying drawings.

BRIEF DESCRIPTION OF THE DRAWINGS

Many aspects of the contact spring assembly for an electronic device can be better understood with reference to the following drawing. The components in the drawing are not necessarily drawn to scale, the emphasis instead being placed upon clearly illustrating the principles of the contact spring assembly for an electronic device. Moreover, in the drawing like reference numerals designate corresponding parts throughout the several views.

DETAILED DESCRIPTION OF THE PREFERRED EMBODIMENTS

Figure 1:
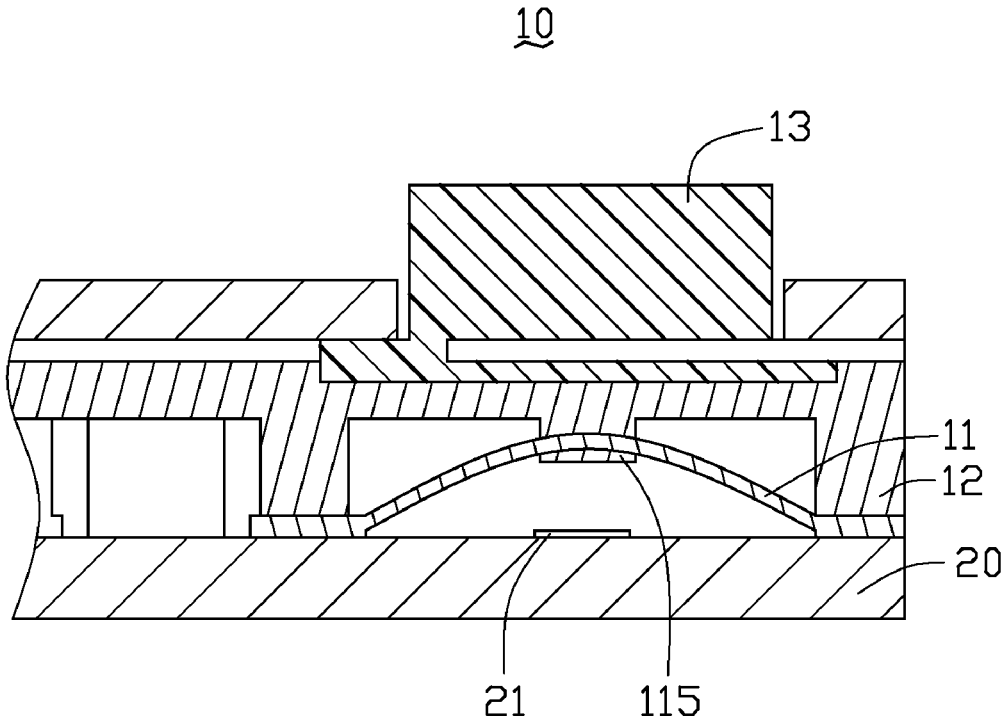
FIG. 1 (RELATED ART)
FIG. 1 is a cross-sectional view of a typical key assembly.
Figure 2:
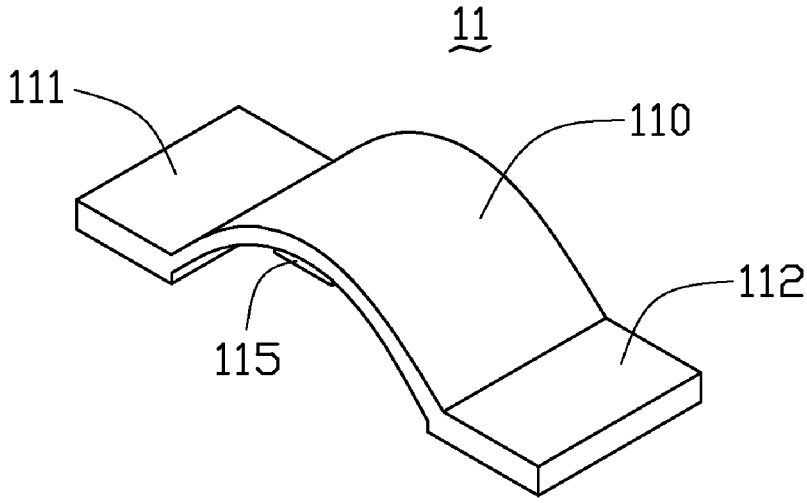
FIG. 2 (RELATED ART)
FIG. 2 is a perspective view of a contact spring used in the typical key assembly shown in FIG. 1.
Figure 3:
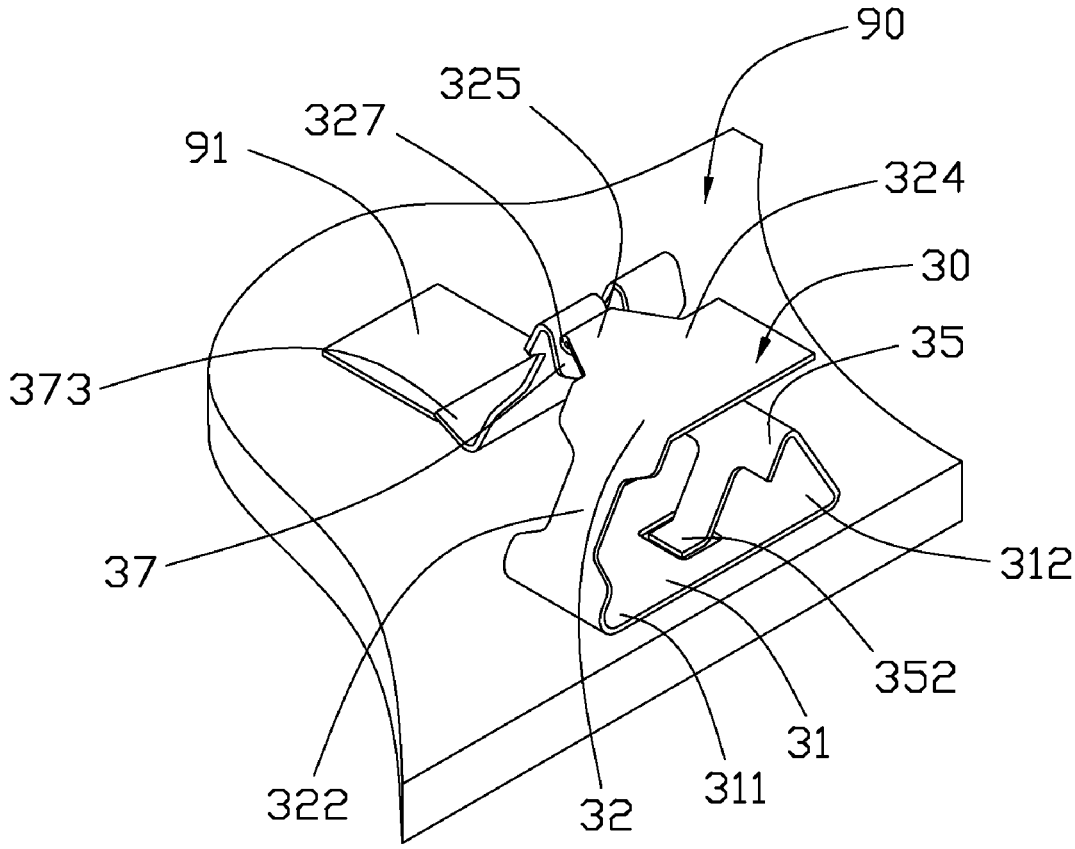
FIG. 3 is a schematic view of a first embodiment of a contact spring assembly for an electronic device mounted on a printed circuit board.

Referring to FIG. 3, in a first embodiment, a first contact spring assembly 30 is mounted on a printed circuit board 90 with at least one conductive contact 91 via surface mount technology (SMT). The first contact spring assembly 30 can be made of metal and integrally formed by a punching process.

Figure 4:
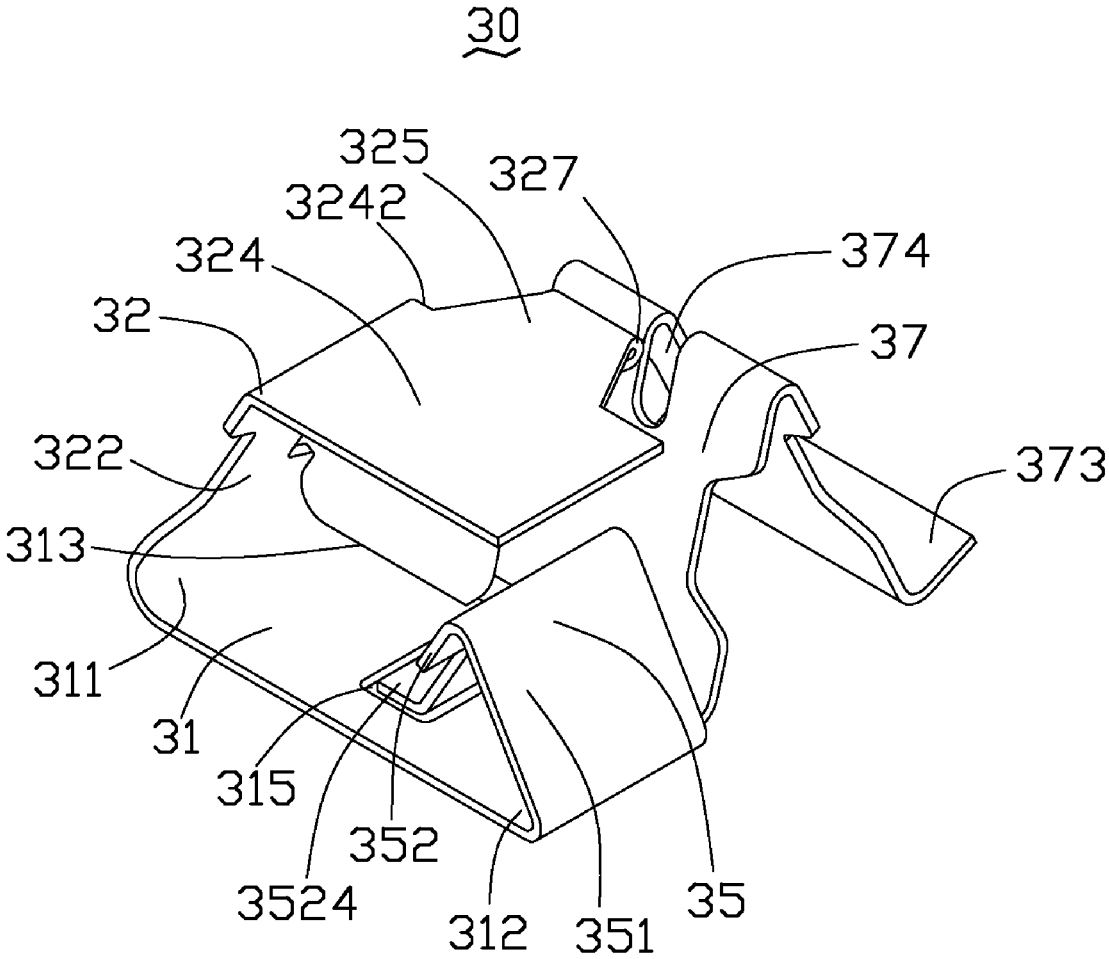
FIG. 4 is a perspective view of the contact spring assembly for an electronic device in a first visual angle, shown in FIG. 1.
Figure 5:
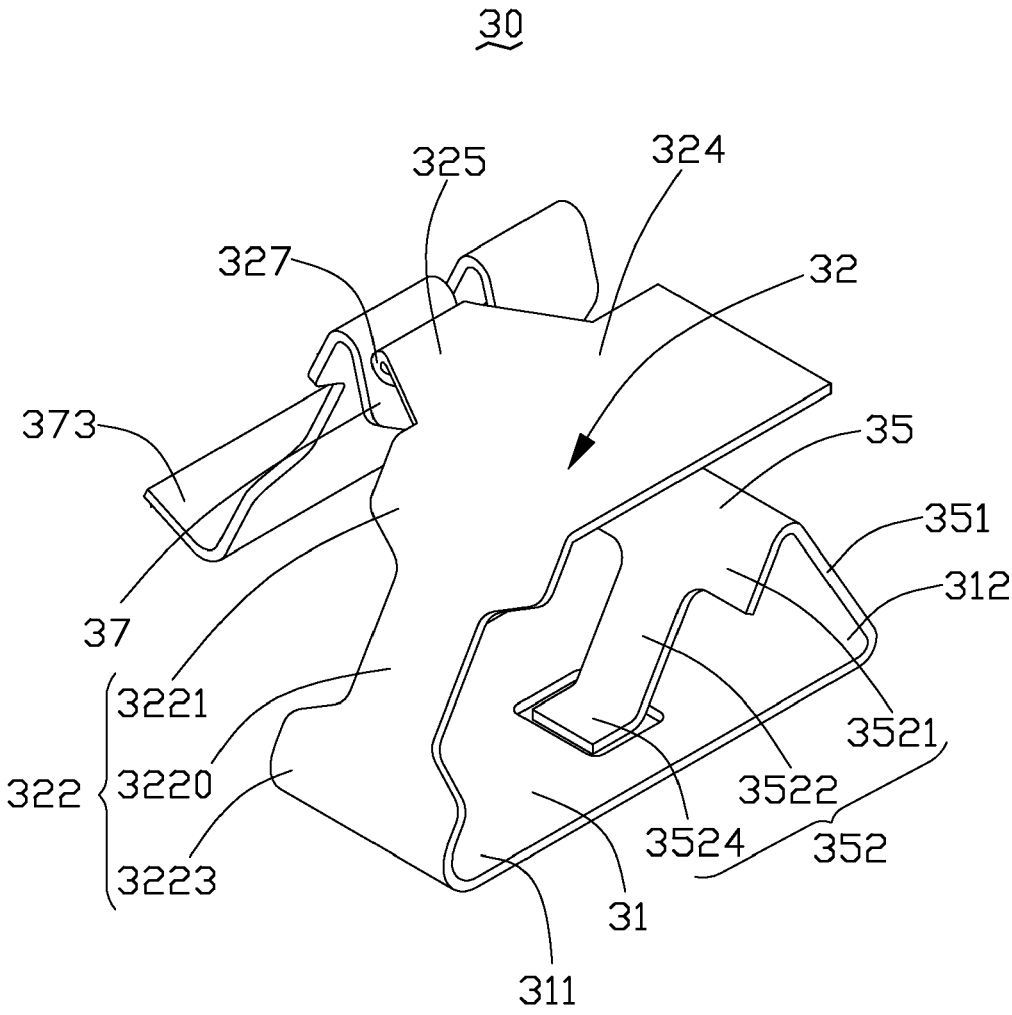
FIG. 5 is a perspective view of the contact spring assembly for an electronic device in a second visual angle, shown in FIG. 1.

Referring to FIG. 4 and FIG. 5, the spring assembly 30 includes a first mounting portion 31, a first press spring 32, a first buffer portion 35, and a first deformable spring 37.

The first mounting portion 31 is a flat plate. The first mounting portion 31 includes a first end 311, a second end 312 opposed to the first end 311, and a lateral end 313 between the first end 311 and the second end 312. The first mounting portion 31 has a through hole 315 formed therein. The through hole 315 is defined adjacent to the middle of the first mounting portion 31.

The first press spring 32 is a bent sheet. The first press spring 32 includes a spring arm 322, a first press segment 324, and a resisting segment 325.

The spring arm 322 includes a first middle portion 3220, a first spring end 3221, and a second spring end 3223. The first spring end 3221 and the second spring end 3223 are disposed at two opposite side of the first middle portion 32201. The width of the first middle portion 3220 is less than that of the first spring end 3221 and the second spring end 3223, so as to improve flexibility of the spring arm 322. The spring arm 322 is bent from the first end 311 of the first mounting portion 31.

Figure 6:
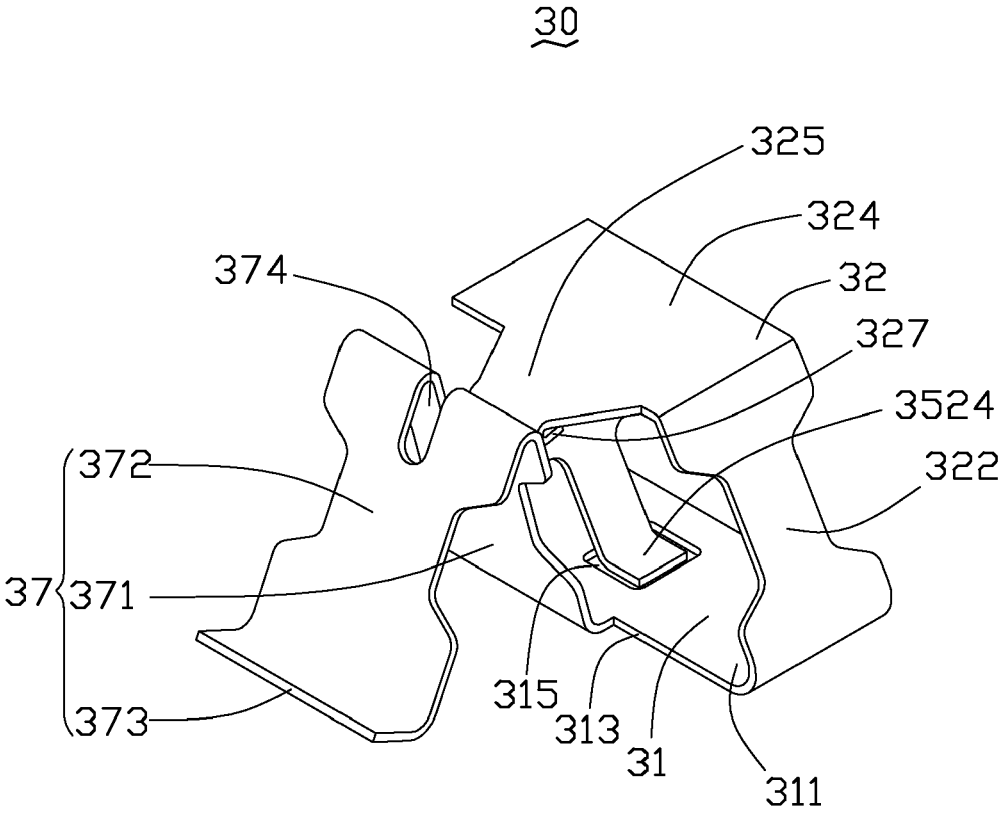
FIG. 6 is a perspective view of the contact spring assembly for an electronic device in a third visual angle, shown in FIG. 1.

The first press segment 324 is bent from one end of the spring arm 322, spaced apart from the first mounting portion 31, and configured in such manner that the first press segment 324 is resiliently depressible together with the spring arm 322 towards the mounting portion 31. The first press segment 324 extends along a direction parallel to the first mounting portion 31. Referring to FIG. 6, it should be understood that the first press segment 324 may also extend along a direction at an angle sloping to the first mounting portion 31.

The resisting segment 325 extends from a lateral side 3242 of the first press segment 324 adjacent to the spring arm 322 and has a first curly edge 327 spaced apart from the lateral side 3242 of the first press segment 324. The first curly edge 327 is configured for resisting the first deformable spring 37.

The first buffer portion 35 is a v-shaped bent sheet. The first buffer portion 35 includes a first buffer arm 351 and a second buffer arm 352. The first buffer arm 351 is bent from the second end 312 of the first mounting portion 31, in such manner that the first buffer arm 351 and the first mounting portion 31 define an acute angle. The second buffer arm 352 is a T-shaped sheet, which has a wide segment 3521, a narrow segment 3522, and a mounting foot 3524 bent form the narrow segment 3522. The narrow segment 3522 is linked between the wide segment 3521 and the mounting foot 3524. The wide segment 3521 is bent from the first buffer arm 351 to form a v-shaped configuration, in such manner that the narrow segment 3522 extends toward the first mounting portion 31, and that the mounting foot 3524 is received in the through hole 315 of the first mounting portion 31. The mounting foot 3524 is mounted on the printed circuit board 90.

Referring also to FIG. 6, the first deformable spring 37 is formed to a v-shaped configuration. The first deformable spring 37 includes a first resilient arm 371, a second resilient arm 372, and a contacting foot 373. The width of a middle portion of the first resilient arm 371 is less than that of two opposite ends of the first resilient arm 371, so as to improve flexibility of the first resilient arm 371. The second resilient arm 372 is constructed similar to the first resilient arm 371. The second resilient arm 372 is bent from one end of the first resilient arm 371. As a result, the first resilient arm 371 and the second resilient arm 372 define the v-shaped configuration. The contacting foot 373 is formed on one end of the second resilient arm 372 opposed to the first resilient arm 371 and configured for electrically connecting with the conductive contact 91 of the printed circuit board 90. It should be understood that a slot 374 can be formed in the first resilient arm 371 and the second resilient arm 372, so as to improve flexibility of the first deformable spring 37.

The first resilient arm 371 is bent from the lateral end 313 of the first mounting portion 31, in such manner that the first resilient arm 371 and the first mounting portion 31 defines an obtuse angle, with the first curly edge 327 of the resisting segment 325 resisting with the first resilient arm 371. The second resilient arm 372 is spaced apart from the first mounting portion 31.

When the first press segment 324 is depressed along a first direction towards the first mounting portion 31, the resisting segment 325 applies a force onto the first resilient arm 371 of the first deformable spring 37, so as to push the first deformable spring 37 to stretch out the second resilient arm 372 with the contacting foot 373 along a second direction towards the conductive contact 91. The second direction is different from the first direction, advantageously, is perpendicular to the first direction. As such, the contacting foot 373 of the first deformable spring 37 can be moved to contact the conductive contact 91 of the printed circuit board 90. When the first press segment 324 resists the first buffer portion 35, the depression of the first press segment 324 is stopped, thereby reducing the potential of permanently deforming of the first press segment 324.

Figure 7:
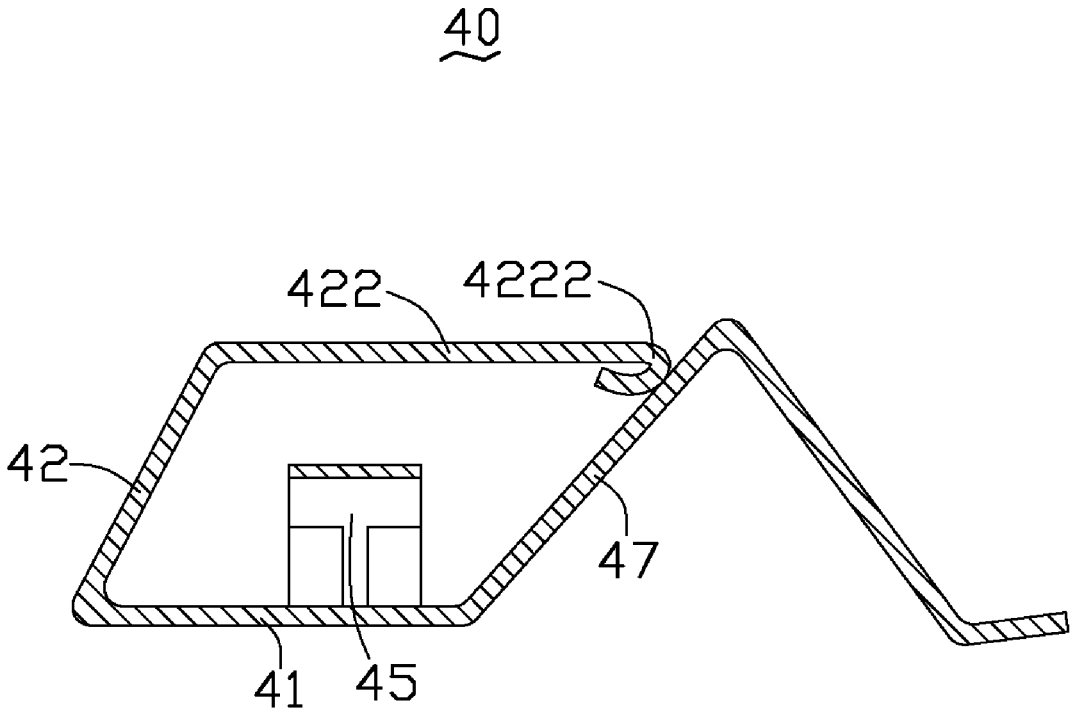
FIG. 7 is a cross-sectional view of a second embodiment of a contact spring assembly for an electronic device.

Referring to FIG. 7, in a second embodiment, a second contact spring assembly 40 is similar to the first contact spring assembly 30. The second contact spring assembly 40 includes a second mounting portion 41, a second press spring 42, a second buffer portion 45, and a second deformable spring 47, which are respectively similar to the first mounting portion 31, the first press spring 32, the first buffer portion 35, and the first deformable spring 37 of the first contact spring assembly 30. The main differences between the second contact spring assembly 40 and the first contact spring assembly 30 are described as follows. The second press spring 42 and the second deformable spring 47 are respectively bent from two opposite ends of the second mounting portion 41. However, the second buffer portion 45 is bent from a lateral side of the second mounting portion 41. The second press spring 42 also has a second press segment 422. The second press segment 422 has a second curly edge 4222 resisting the second deformable spring 47.

It should be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact spring assembly for an electronic device, comprising:

a mounting portion configured to be mounted on the electronic device;

a resiliently depressible press spring bent from the mounting portion; and a deformable spring bent from the mounting portion, the deformable spring including a first resilient arm, a second resilient arm, and a contacting foot the first resilient arm being bent from the mounting portion, the second resilient arm being bent from the first resilient arm, the electrical connection to a printed circuit beard of the electronic device;

wherein the press spring resiliently depressibly resists the deformable spring, the press spring being configured to be moved along a first direction thereby pushing the deformable spring to move along a second direction different from the first direction.

2. The contact spring assembly as claimed in claim 1, wherein the mounting portion includes two opposite ends, the press spring being bent from one of the two opposite ends of the mounting portion, the deformable spring being bent from the other one of the two opposite ends of the mounting portion.

3. The contact spring assembly as claimed in claim 1, wherein the mounting portion includes two opposite ends and a lateral end between the two opposite ends, the press spring being bent from one of the two opposite ends of the mounting portion, the deformable spring being bent from the lateral end of the mounting portion.

4. The contact spring assembly as claimed in claim 1, wherein the contact spring assembly is made of metal and integrally formed by a punching process.

5. The contact spring assembly as claimed in claim 1, wherein the press spring includes a spring arm, a press segment, and a resisting segment the spring arm being bent from the mounting portion, the press segment being bent from one end of the spring arm, spaced apart from the mounting portion, and configured in such manner that the press segment is resiliently depressible together with the spring arm toward the mounting segment, the resisting segment extending from the press segment and having a curly edge resisting the deformable spring.

6. The contact spring assembly as claimed in claim 5, wherein the press segment extends along a direction parallel to the mounting portion

7. The contact spring assembly as claimed in claim 5, wherein the press segment extends along a direction at an angle sloping to the mounting portion.

8. The contact spring assembly as claimed in claim 5, wherein the spring arm is structured in such manner that a middle portion thereof has a width less than that of two opposite ends thereof.

9. The contact spring assembly as claimed in claim 1, wherein the first resilient arm is structured in such manner that a middle portion thereof has a width less than that of two opposite ends thereof.

10. The contact spring assembly as claimed in claim 1, wherein a slot is formed in the first resilient arm and the second resilient arm.

11. The contact spring assembly as claimed in claim 1, wherein the first resilient arm is bent from the mounting portion in such mariner that the first resilient arm and the mounting portion define an obtuse angle, the second resilient arm being spaced apart from the mounting portion.

12. The contact spring assembly as claimed in claim 1, further comprising a buffer portion, the buffer portion comprising a first buffer arm and a second buffer arm, the first buffer arm being bent from one end of the mounting portion, in such manner that the first buffer arm and the mounting portion define an acute angle, the second buffer arm being bent from the first buffer arm.

13. The contact spring assembly as claimed in claim 12, wherein the second buffer arm is a T-shaped sheet, which has a relatively wide segment, a relatively narrow segment, and a mounting foot bent form the relatively narrow segment, the relatively narrow segment being linked between the relatively wide segment and the mounting foot.

14. The contact spring assembly as claimed in claim 13, wherein the mounting portion has a through hole fanned therein, the relatively wide segment being bent from the first buffer arm to form a v-shaped configuration, in such manner that the relatively narrow segment extends toward the mounting portion, and the mounting foot is received in the through hole of the mounting portion and mounted on a printed circuit board of the electronic device.

* * * * *